US005489076A

United States Patent [19]

Thomas

[11] Patent Number: 5,489,076

[45] **Date of Patent: * Feb. 6, 1996**

[54] SUPPORT POST

[76] Inventor: John E. Thomas, 50 Mary Street, Lindsay, Ontario, Canada, L9V 4S7

[ * ] Notice: The portion of the term of this patent subsequent to Aug. 23, 2011, has been disclaimed.

[21] Appl. No.: 223,231

[22] Filed: Apr. 5, 1994

Related U.S. Application Data

[63] Continuation-in-part of Ser. No. 93,660, Jul. 20, 1993, Pat. No. 5,340,065.

[51] Int. Cl.[6] ..... A47G 23/02

[52] U.S. Cl. ..... 248/150; 40/607; 40/610; 248/156; 248/166; 248/508

[58] Field of Search ..... 248/150, 165, 248/166, 156, 440, 508, 159; 40/606, 607, 610

[56] References Cited

U.S. PATENT DOCUMENTS

| | | | |
|---|---|---|---|
| 4,249,715 | 2/1981 | Repp | 40/607 |
| 4,343,449 | 8/1982 | Osthus | 248/156 |
| 4,441,679 | 4/1984 | Calet | 40/607 X |
| 4,825,575 | 5/1989 | Rethke | 40/610 |
| 4,888,894 | 12/1989 | Brown, Jr. | 40/606 |
| 4,910,901 | 3/1990 | Boyar | 40/606 X |
| 5,340,065 | 8/1994 | Thomas | 248/150 |

*Primary Examiner*—Ramon O. Ramirez

[57] ABSTRACT

A support for an outdoor sign has an upright where an upper and lower extent are swingably connected to move between an erect position for use and a collapsed position for storage. A cross-bar is pivotally connected to the upright for movement between a perpendicular relation to the upright, for use, and a collapsed position for storage.

22 Claims, 10 Drawing Sheets

Figure 1:
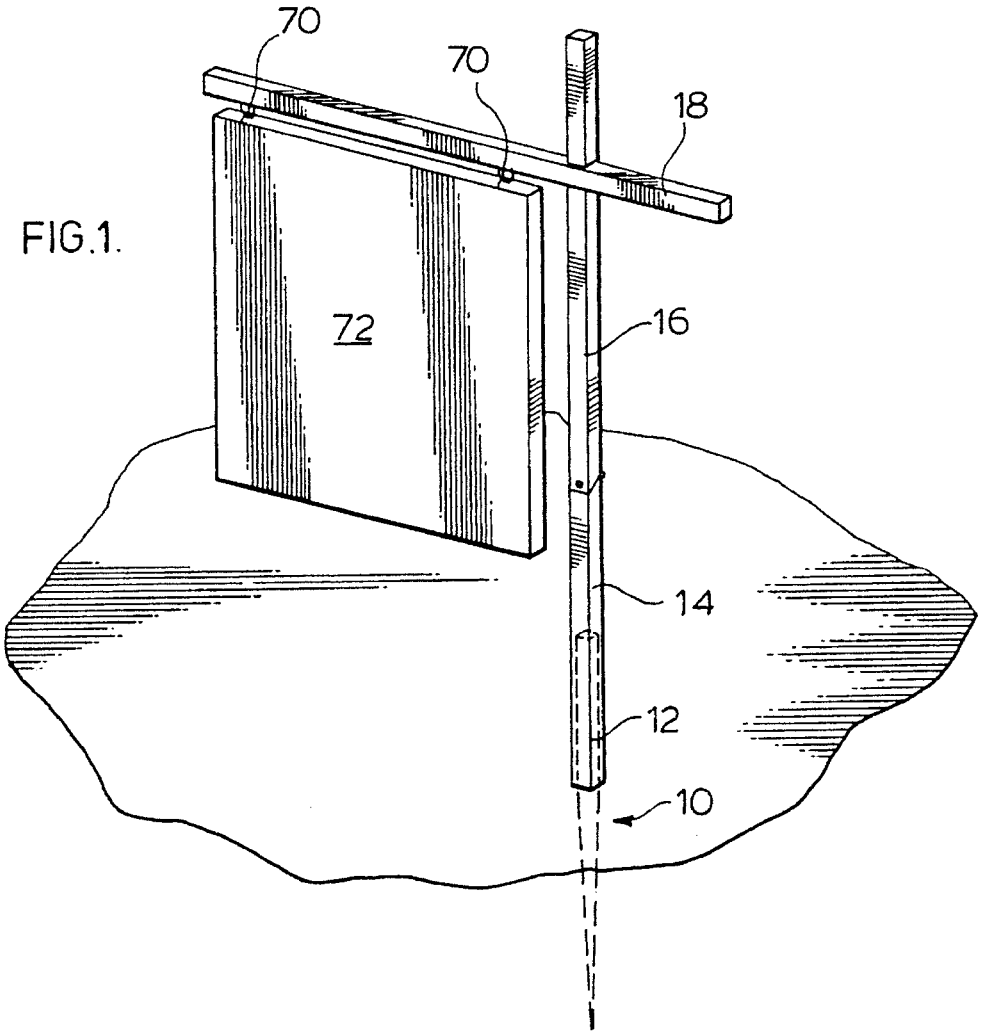

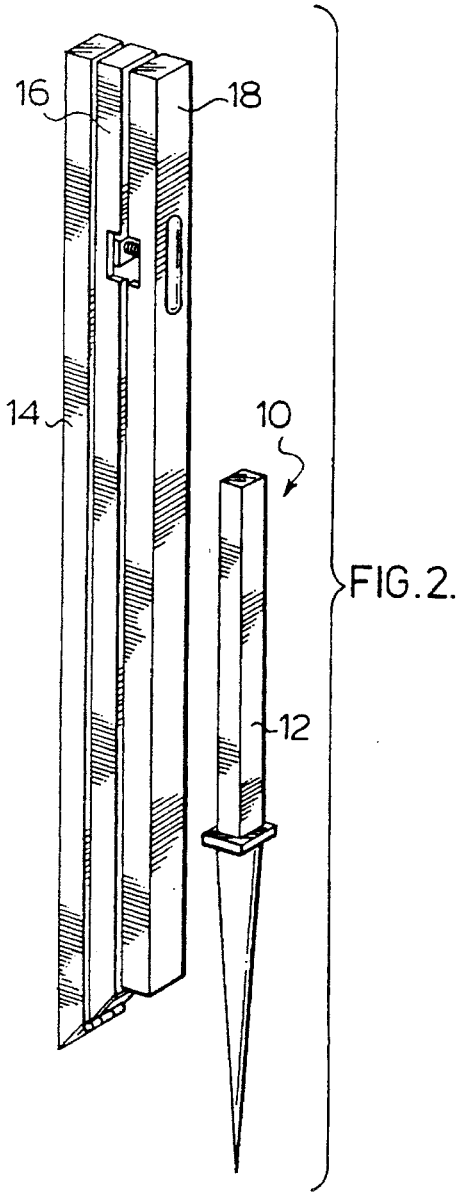
FIG.6.
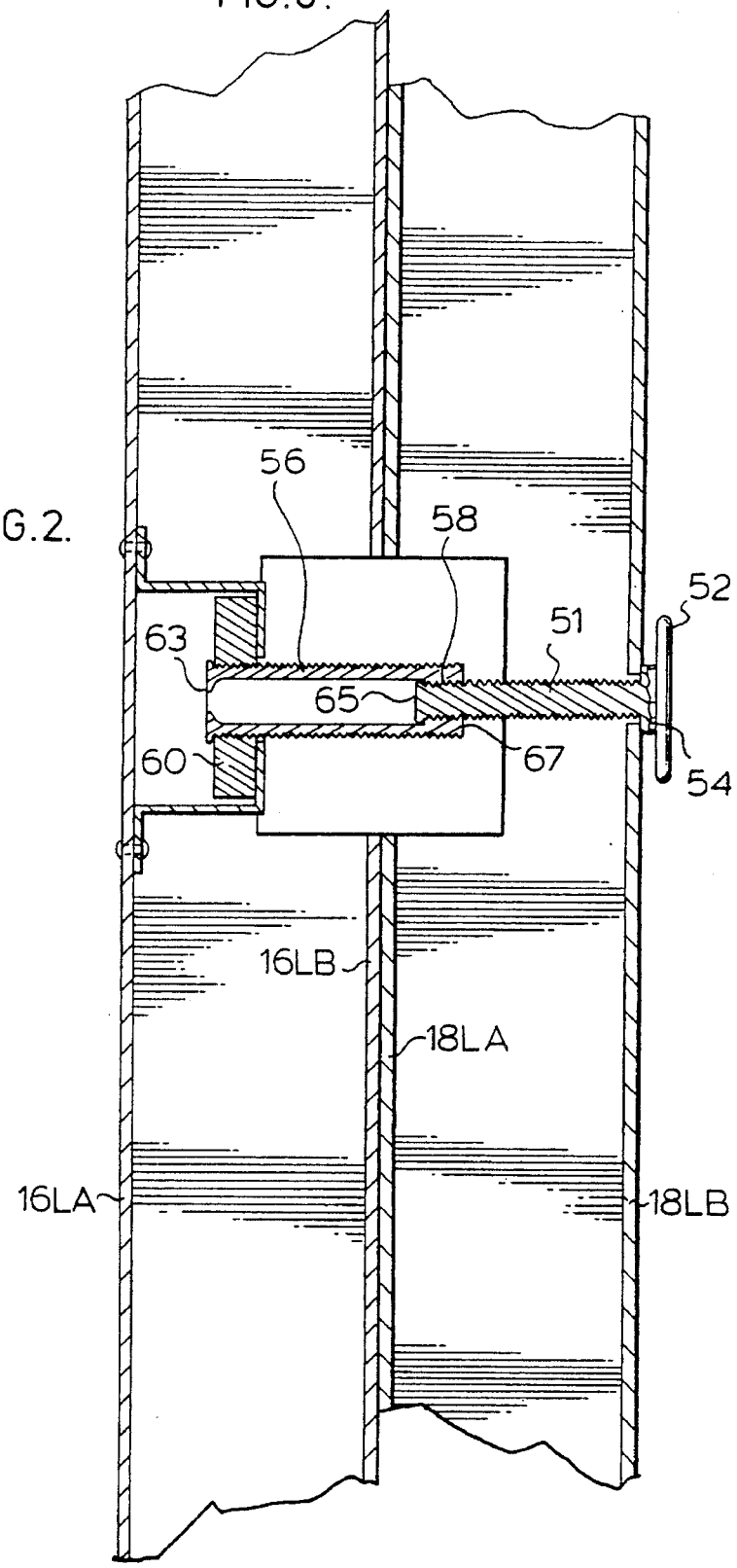

FIG. 5A.
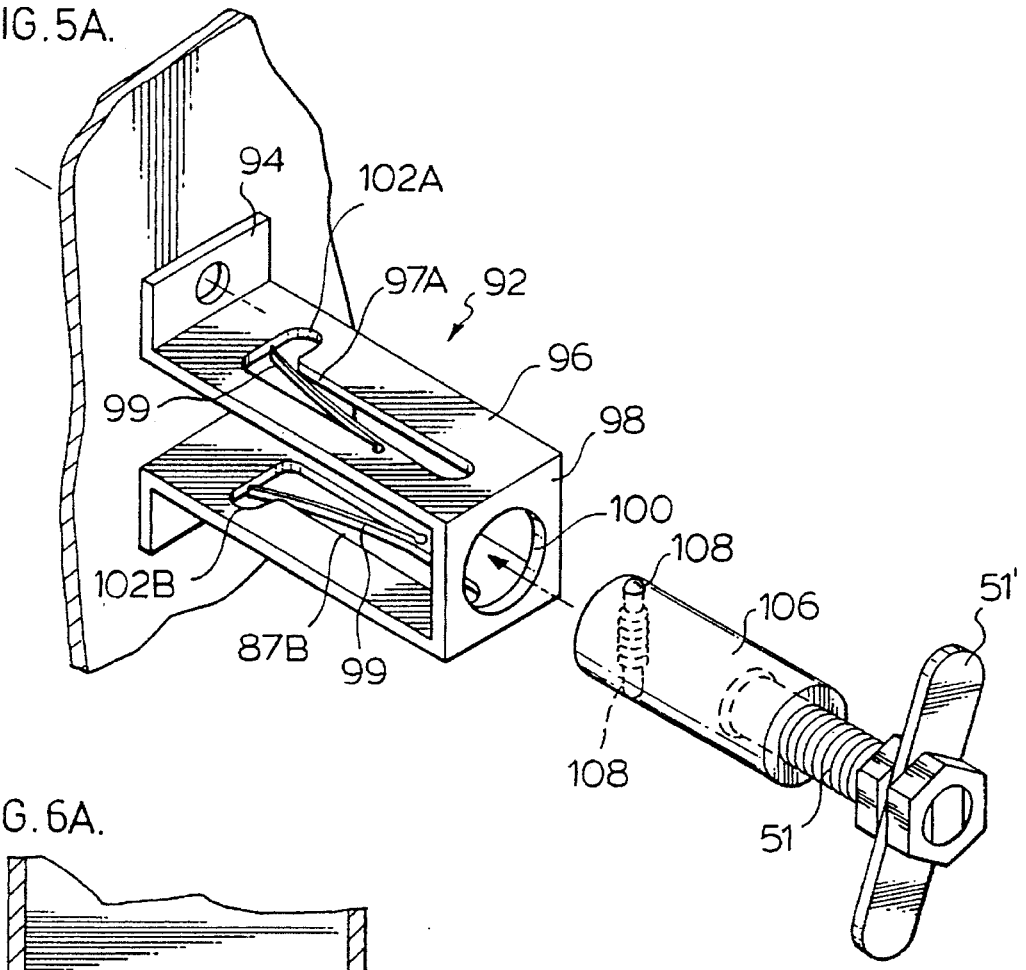
FIG. 6A.
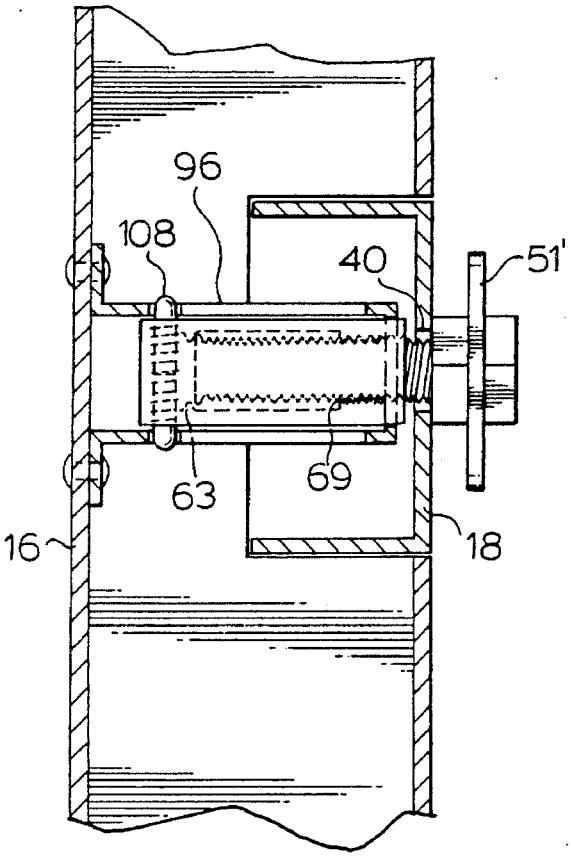
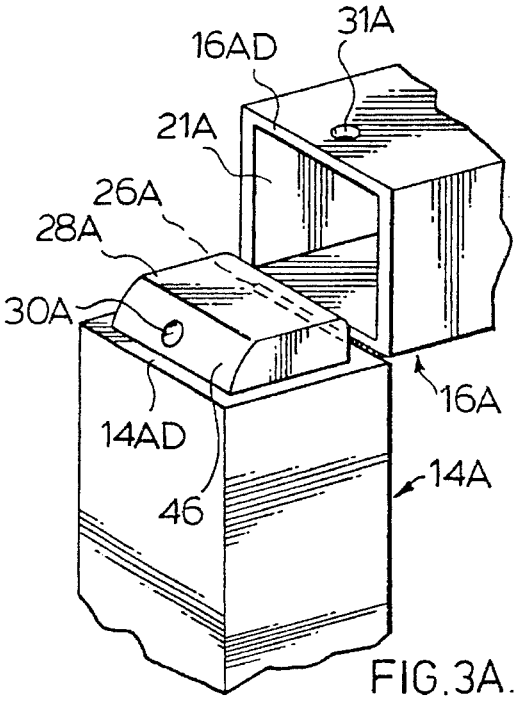
FIG. 3A.

SUPPORT POST

This application is a continuation-in-part of application Ser. No. 08/093,660 filed Jul. 20, 1993, now U.S. Pat. No. 5,340,065.

The present invention relates to a support post designed for mounting on a supporting surface and when so supported to, in turn, support a sign.

The support post is particularly suitable for temporary installation on built or building lots which are for use by real estate agents bearing such indicia as "For Sale" "For Rent" or "Open House". However, the invention may be used for many other purposes and signage.

Conventional signs are made of relatively heavy wood or metal, often 5' high with a horizontal arm 3' long and are too heavy for many agents to handle, and too large for easy packing and transportation in an automobile. Moreover conventional signs are composed of too many separate parts and are laborious to erect. For this reason, in many cases the agent does not install his or her own signs but rather the signs must be installed by an independent contractor.

It is an object of this invention to provide a design for a post support which may be made of light materials and which is collapsible into a relatively small bundle for easy transportation in the trunk of an automobile. The collapsed sign is also easily shipped by a courier and may be within the permissible parcel size for UPS courier.

It is an object of a preferred embodiment of this invention to provide a design for an upright in accord with the foregoing paragraph wherein upper and lower extents forming the upright although manipulable between ERECTED and COLLAPSED position are always connected to reduce the risk of loss of a component.

It is an object of this invention to provide a design for a post support which lends itself to an attractive appearance, so that its appearance is at least as attractive as the heavier, and often more expensive, signs of the prior art.

It is an object of this invention to provide for a post support having an upright which is, on the one hand, light and compact in COLLAPSED position but in the ERECTED position is strong enough for its use in a relatively large and heavy structure, and for winds in excess of 65 m.p.h.

In accord with one aspect of the invention separate upper and lower longitudinally extending extents are swingably connected or hinged for movement between an ERECTED position where said extents are longitudinally aligned for use and a COLLAPSED position where the extents are side by side for transportation or storage. In accord with another aspect of the invention a cross-bar is designed, in combination with the upper extent, to be arranged PERPENDICULAR to the upper extent for use or PARALLEL to the upper extent for storage or transportation.

By 'swingable' herein I include pivotal and also more complex rotary motions such as that provided by the articulated linkage described specifically. I note that such swingable motion provides relative rotation of the swingably connected members about a plurality of mutually parallel axes.

In accord with a preferred embodiment of the invention, the cross-bar is pivotally connected to the upper extent, for movement between PERPENDICULAR and PARALLEL attitude.

In preferred arrangements described herein the upper and lower extents may be solid or tubular. If solid then, in the erected position, they meet in the erected position in mutually facing surfaces. If tubular, then in the ERECTED position they meet in the erected position in mutually facing edges. Such mutually facing surfaces or edges will approximately define a plane. Thus, the extension members may be fixed in erected relationship to each other by a bolt generally passing at an angle to the plane and transverse to the pivot axis so that it passes through portions of both the upper and lower extent to fix them in relative position. Preferably the upper and lower members are shaped at their mutually facing portions to provide a plane in the ERECTED position which is up to 65° to the longitudinal direction of the then aligned members. In this way a bolt extending perpendicular to the pivot axis and the longitudinal direction may connect the partially overlapping members.

In a preferred embodiment of the invention, as defined in the last paragraph upper and lower tubular extents have when aligned complementary edges sloping at an angle of up to 65° to the longitudinal direction.

A core in the tubular passage is fixed to one of the extents. The core extends a short distance inside one of the extents and is fixed thereto and projects beyond the extent in which it is mounted sufficiently to rest inside the other extent in ERECTED position but not far enough to inhibit the relative swinging of the upper and lower extents about the swingable connection. Detachable attaching means, connect the other extent to the core in the aligned (ERECTED) position of the extents and reenforce the strength of the connection between the members in the ERECTED position. The inventive design for the swingably connected upper and lower extents may be used for many varieties of sign besides those described herein.

There is also disclosed herein an alternative arrangement for fixing the relative attitudes of said upper and lower extents (which for this alternative are tubular) in ERECTED position. In accord with such alternative, one of the upper or lower members is provided with a coupling member which is swingably mounted on one of the extents to swing about axes, which are parallel to but not coincident with, the axes defined by the swingable connection of the extents. The coupling member is designed to be partly contained in the extent on which it is swingably mounted and to project out of said extent in a direction to be received in the tubular passage of the other extent in ERECTED position. (Both swingable connections are preferably pivotal) The coupling member is adapted to move between two limiting positions. In a first limiting position the coupling member is adapted to be detachably connected to the other extent to that to which it is swingably connected, and when so detachably connected to lock the members in ERECTED position. In the second limiting position, which may be a range of positions, the coupling member is adapted to allow rotation of the members relative to each other between ERECTED and COLLAPSED position. Means are described for controlling or permitting the movement of the coupling member between limiting positions.

Preferably, the two extents are of a rectilinear section. The swingable connections of extents to each other and of the coupling member to one extent, are about axes parallel to one wall of one of the extents and the respective walls of the two are approximately co-planar.

The coupling member U section has the wall forming the cross-bar of the U Parallel to the axes of the swingable extent connections and is shaped to provide a panel resting in the ERECTED position, against the wall of the other extent which is opposite to the wall which is swingably connected to the one extent. Thus the detachable coupling may provide one of a number of arrangements discussed herein, wherein a shank mounted on one of the coupled members may be detachably connected to the other. With such coupling member of U shape section, the respective walls, forming the uprights of the U, rest in the ERECTED position against side walls of the other extent, contributing to the rigidity of the connected upper and lower extents in erected position.

In most variants of the arrangement just described a relatively inexpensive mechanism is provided since simple pivotal connections, rather than complex linkages, may be used between connected extents and for the connection between the coupling member and one of the extents.

An alternative connection between the upper and lower extents for movement between ERECTED and COLLAPSED position, is to connect the upper and lower extents in a swingable (usually pivotal) manner for relative movement and to provide (without a coupling member internal to a tubular extent) a simple fastening mechanism for retaining the members in ERECTED position. Such fastening means may be combined with a lock (key or combination) which in erected position can only be opened by the users key (or by a dialling of an equivalent combination,) and which, therefore, may only be detached, for movement to COLLAPSED position, by authorized personnel.

Thus fastening means, in the general may be the mechanisms for (a) fastening a window sash or (b) a lunch box. Either such mechanisms and others, may conveniently be combined with a key or combination lock.

The invention also provides, in a preferred aspect, a permanent pivotal connection between the cross-bar and the upright. If the upright has upper and lower extents, the connection is to an upper extent. In U.S. Pat. No. 4,843,746 to Daniel P. DesNoyers, et al, there is shown a support post wherein the cross-bar and the upper extent are provided with mutually facing notches whereby the cross-bar and upper extent may be bolted together in mutually perpendicular relation for use and separated when not in use. However, there is not provided a suitable permanent pivotal attachment between the members.

This invention provides a cross-bar and an upright (preferably its upper extent) which cross-bar and upright are pivotal between a PERPENDICULAR position for use and a PARALLEL position for storage. Since the members may be left permanently connected, no risk of loss of one of them ensues. Such pivotal connections may be by permanently attached bolt. In a preferred aspect of this invention mutually facing recesses in the upright and cross-bar members allow for interlocking in the PERPENDICULAR orientation. Thus the transverse thickness of the upright and cross-bar members is, in the PARALLEL position, the sum of their transverse thicknesses. However, in the PERPENDICULAR position the total transverse thickness of the members is less than this sum and may be one-half of it. Accordingly, this change in the transverse thickness must be provided for by the pivotal connection. In one aspect of the invention the pivotal connection provides a telescopic bolt having a head end which limits outward transverse movement of one of the members and a nut end which limits outward transverse movement of the other. A telescopic sleeve has inside and outside threading in the same sense so that a head shank may screw in one threading and a nut shank in the other. The maximum transverse spacing (for PARALLEL position) is therefore the non-overlapped length of the nut shank, sleeve, and bolt shank. The minimum transverse spacing (for PERPENDICULAR position) is achieved when there is maximum overlap between the two shanks and the sleeve.

In a preferred embodiment of the invention as described in the lines above, a bolt shank and sleeve for joining the cross-bar and upright comprises a standard threaded bolt combined with a longitudinally extending sleeve member. The sleeve member has internal threading to receive the bolt threading and external threading to thread into threaded mount on one of the cross-bar or upper extension members farthest from the bolt head. The result is that the spacing of the bolt head from the farthest wall may vary from the position for clamping the upper extension and cross-bar member in PERPENDICULAR attitude to the spacing for clamping in the PARALLEL attitude. This difference in spacing results, assuming both members are the same thickness and notched to the depth of half of this, in a relative change of the bolt length of approximately the thickness of one of the members. Thus the inventive arrangement allows such bolt displacement without having an unsightly bolt end projecting for approximately the thickness of one of the members in the PERPENDICULAR attitude as would be the case if a simple bolt were used.

In an alternative the sleeve is threaded to one of the bolt or head and is provided with a bayonet connection to the other. With applicant's construction, the arrangement provides for permanent pivotal attachment of the upright and the cross-bar. Moreover, it will be noted that with applicant's arrangement the cross-bar may be clamped to the upper extent in either PERPENDICULAR (for use) or PARALLEL position (for storage).

In a further alternative method for pivotally connecting the cross-bar and a longitudinal extent. As before the transverse width of the combined extent is approximately one half, in the interlocked (PERPENDICULAR) arrangement, of the width in the PARALLEL arrangement.

At the interlock location, a tubular cross-bar and tubular extent are open toward each other both defining a wall remote from the other and facing the interlock opening. One of these walls mounts a rotatable shank projecting toward the other and the other of these walls mounts a fixed shank projecting toward the other. A sleeve is adapted to receive one of these shanks and to be received by the other. Each sleeve-shank connection provides a bayonet slot to guide a stud into a side slot at maximum overlap. The senses of turning the studs into the side slots is such that the same sense will telescope both shanks at the overlap which will hold the members in interlock (PERPENDICULAR) position. On the other hand, when the studs are released from the side slots the sleeve allows reductions of both overlaps to a degree to allow the members to be oriented in the parallel spacing.

Preferably a screw member combined with the rotatable shank provides a fine adjustment and allows a tight clamping in either orientation.

The rotational connection of the cross-bar and uprights described and claimed herein may be used for many signs other than that described herein.

The rotational connection of the cross-bar and uprights described and claimed herein may be used for many signs other than those described herein.

In drawings which illustrate a preferred embodiment of the invention:

FIG. 1 is a perspective of a post support in accord with the invention with upper and lower extents in ERECTED position and the upper extent and cross-bar in PERPENDICULAR position.

Figure 3:
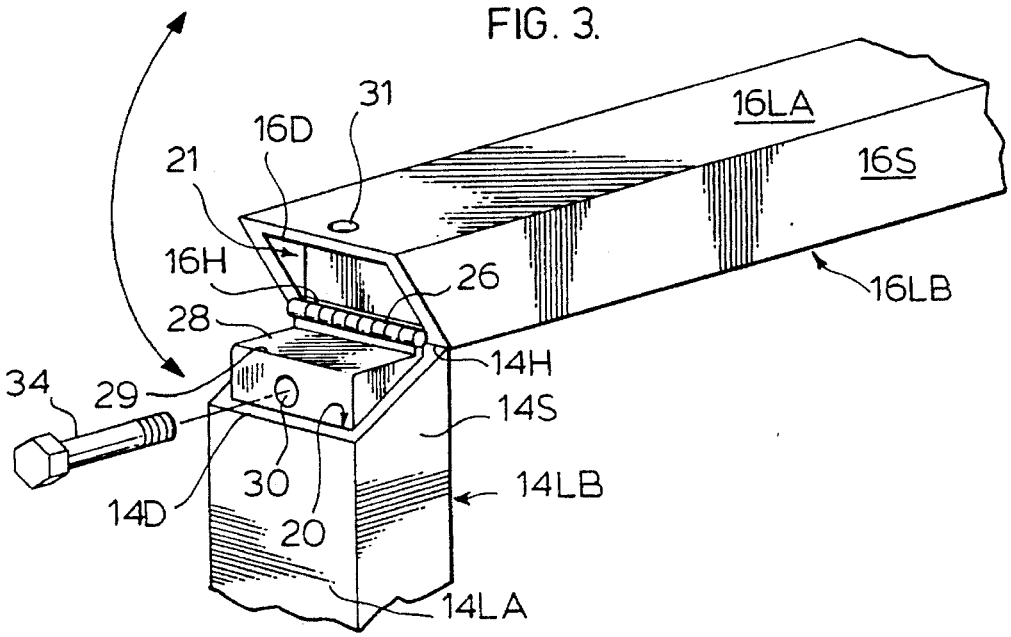
Figure 4:
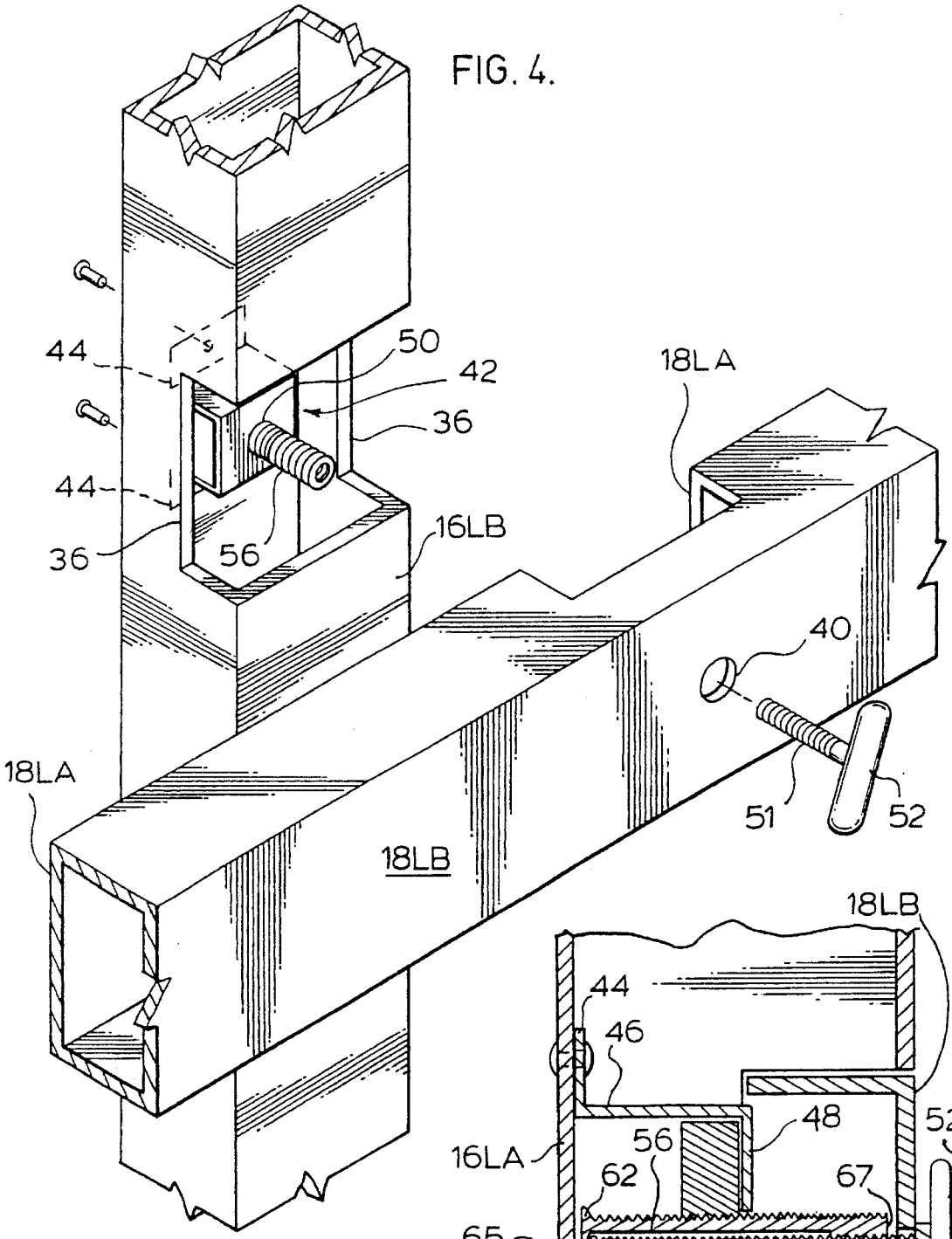
Figure 5:
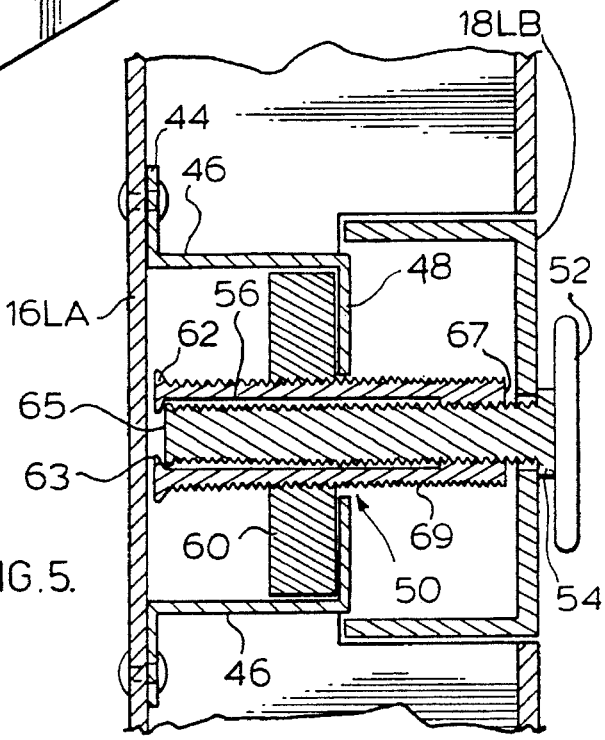
Figure 7:
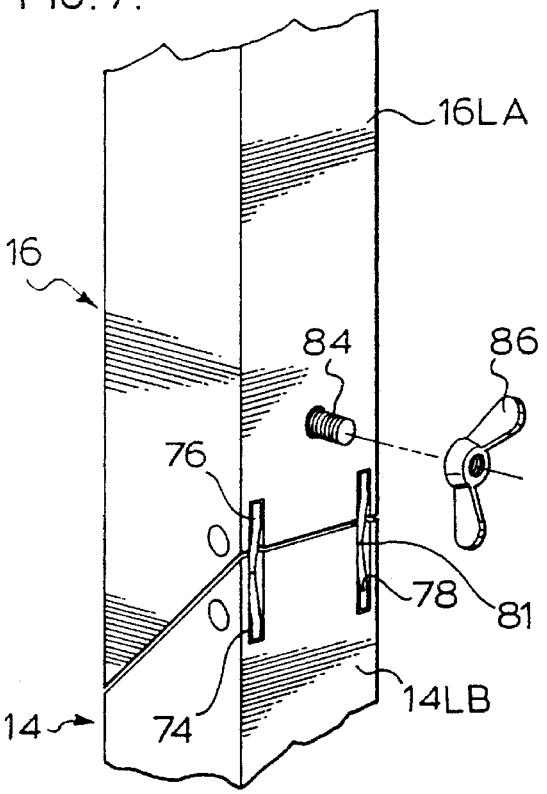
Figure 8C:
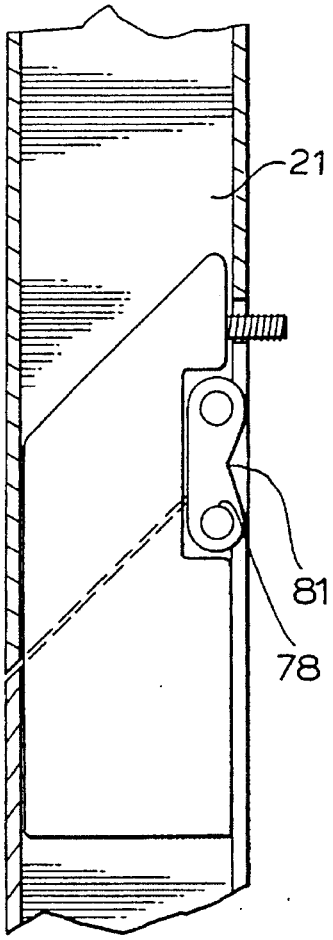
Figure 8B:
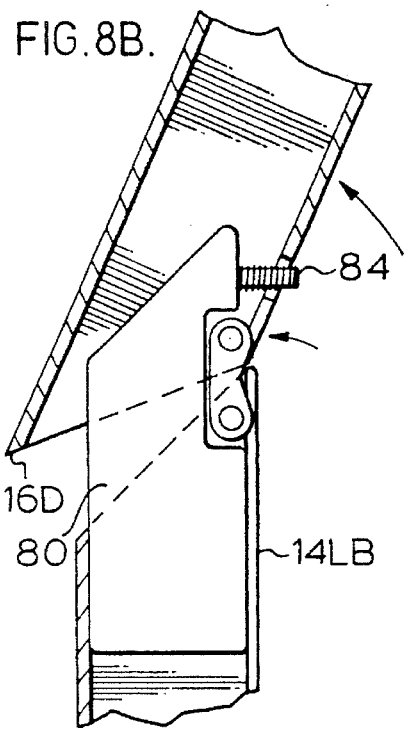
Figure 8A:
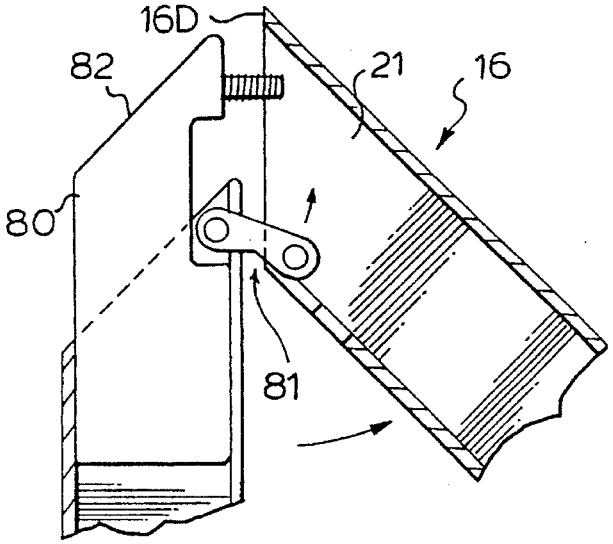

FIG. 2 is a perspective of the post support of FIG. 1 with the upper and lower extents in COLLAPSED position and the upper extent and cross-bar in PARALLEL position, FIG. 3 is a detail of the connection between the upper and lower extents, FIG. 3A is an alternate arrangement, FIG. 4 is an exploded detail of the connection between the upper extent and the cross-bar, FIG. 5 is a section of the connection of the upper extent and the cross-bar taken at right angles to the cross-bar, with the members in PERPENDICULAR relation, FIG. 6 is a section of the connection shown in FIG. 5, and from the same view point with the members in PARALLEL relation, FIGS. 5A and 6A show an alternate connection of the upper extent and the cross-bar, FIGS. 7, 8A, 8B and 8C show a swingable connection between the upper and lower extents which is an alternate to that shown in FIG. 3.

Figure 9:
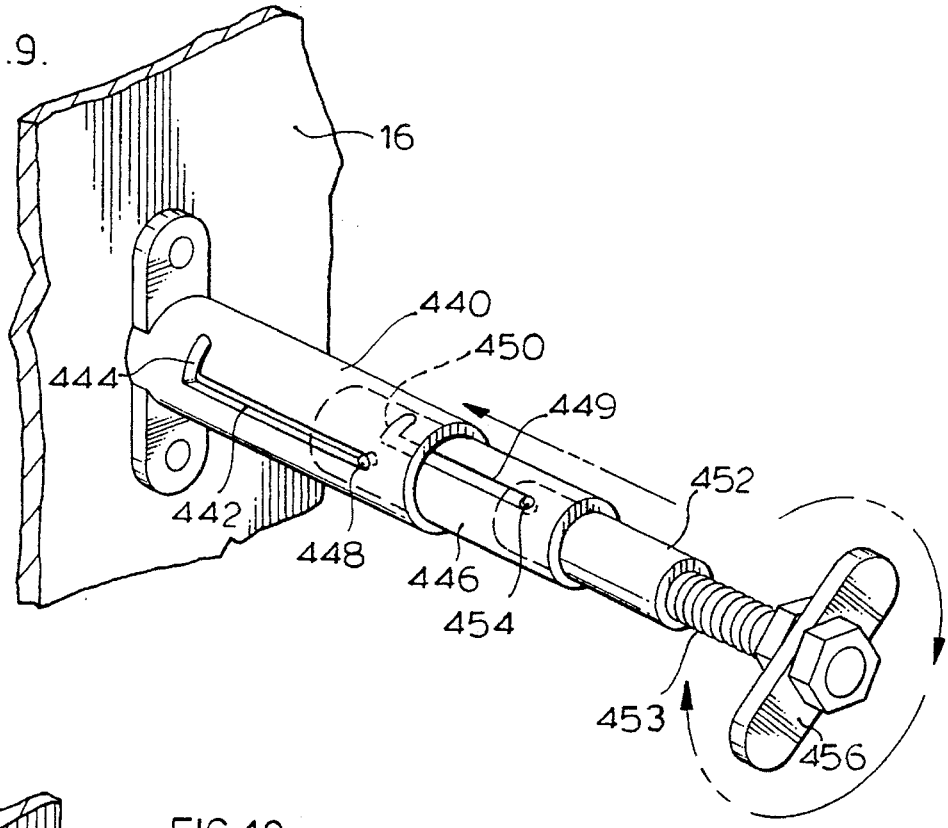
Figure 10:
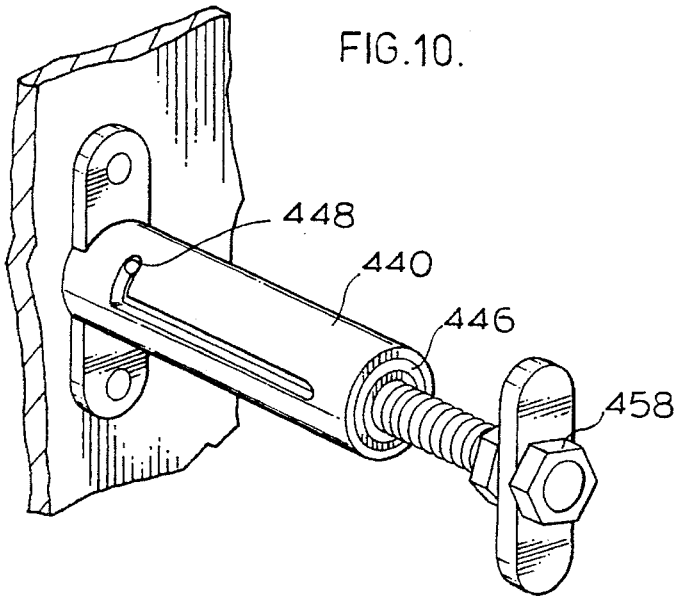
Figure 11A:
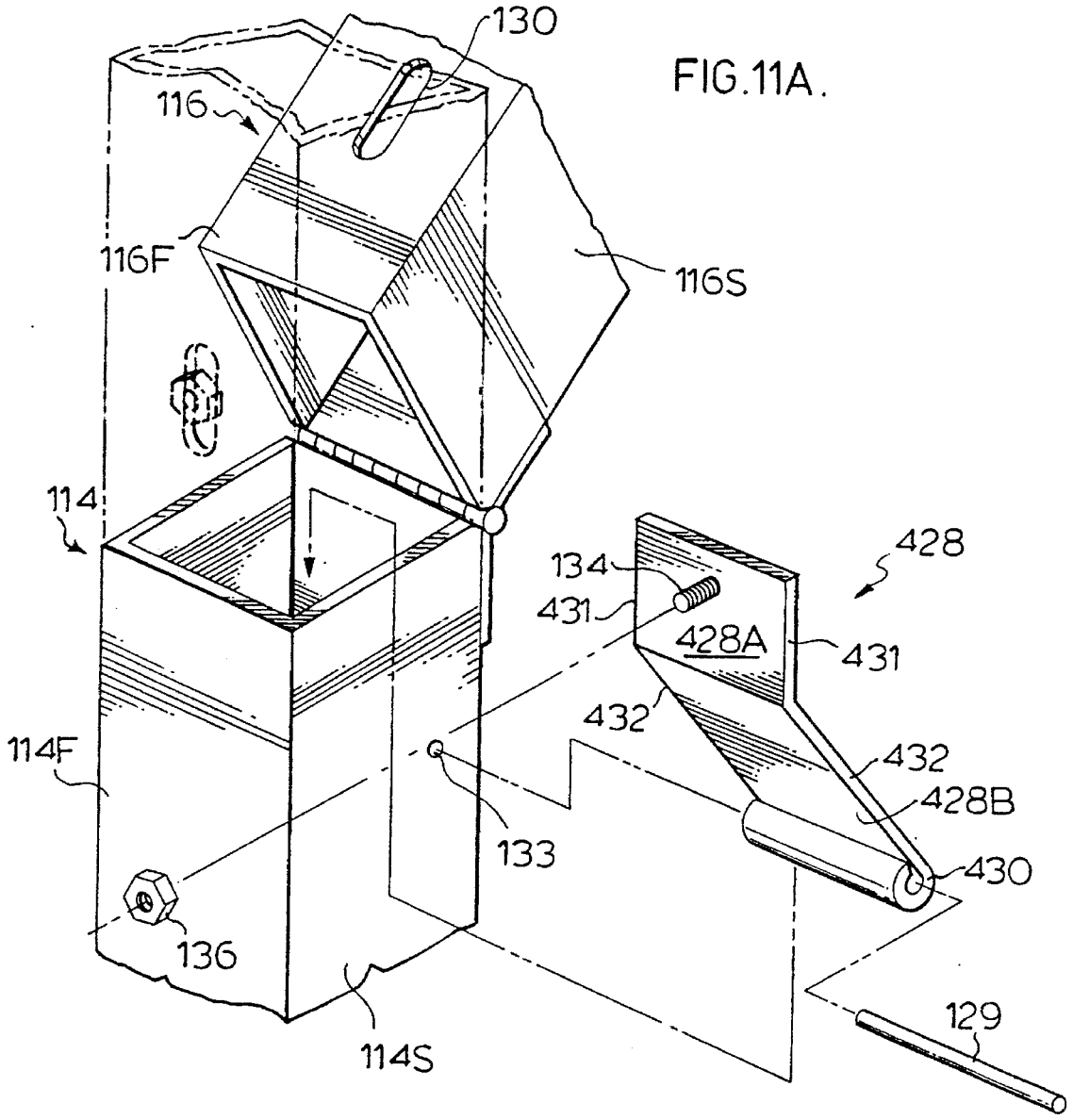
Figure 11:
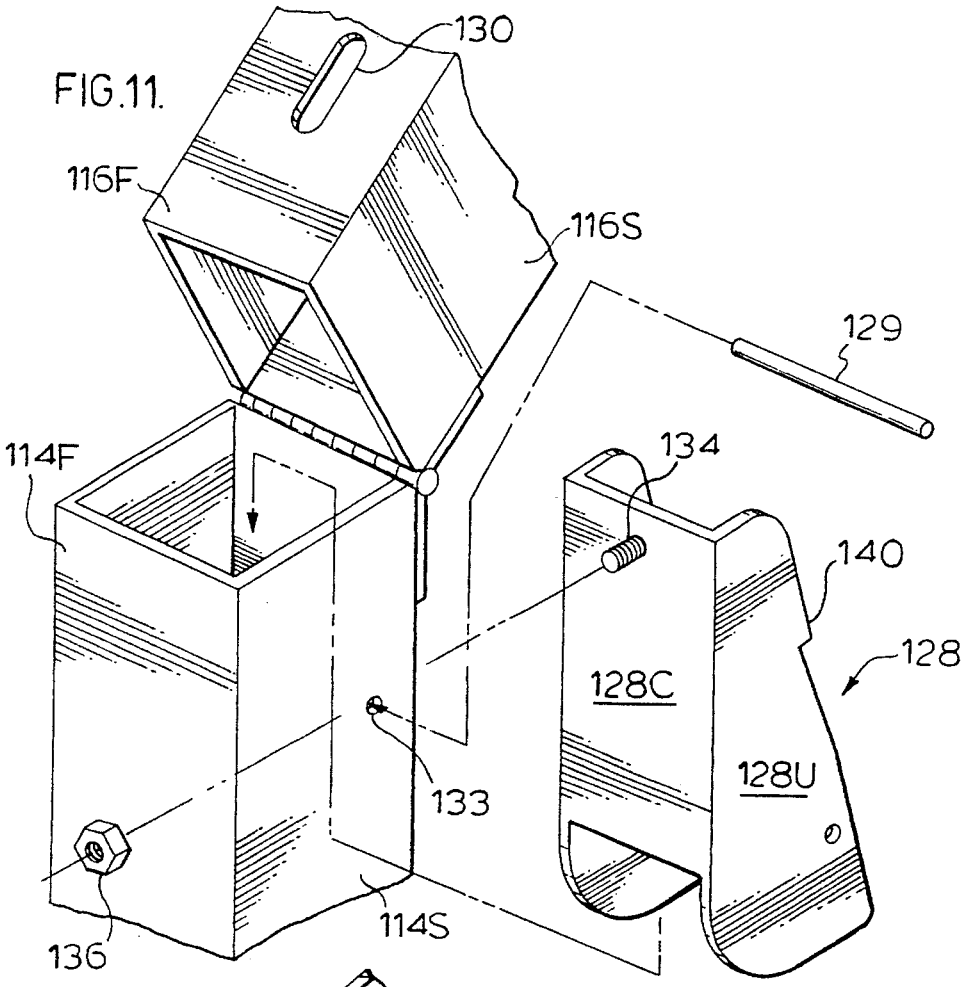
Figure 12:
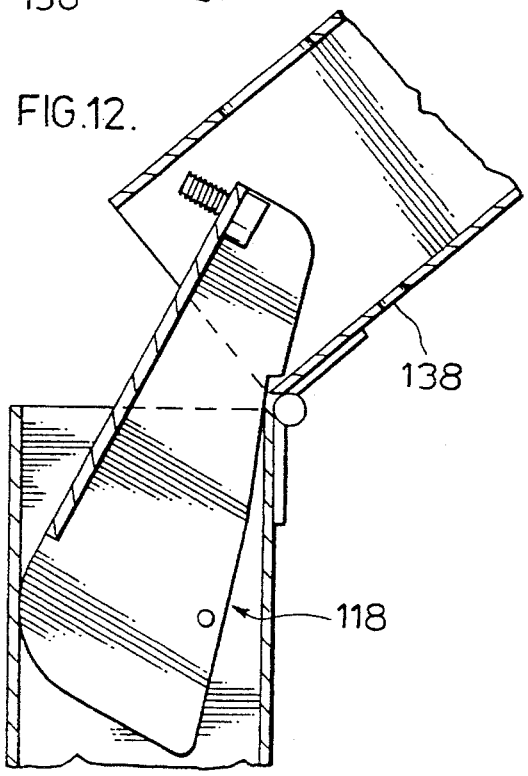
Figure 13:
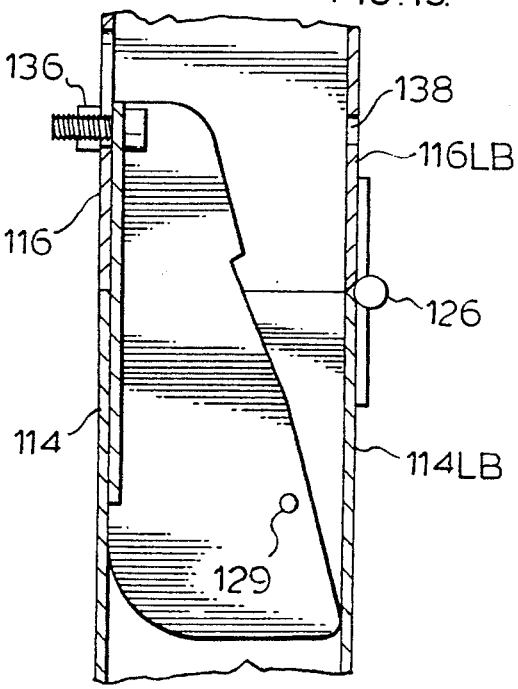
Figure 14:
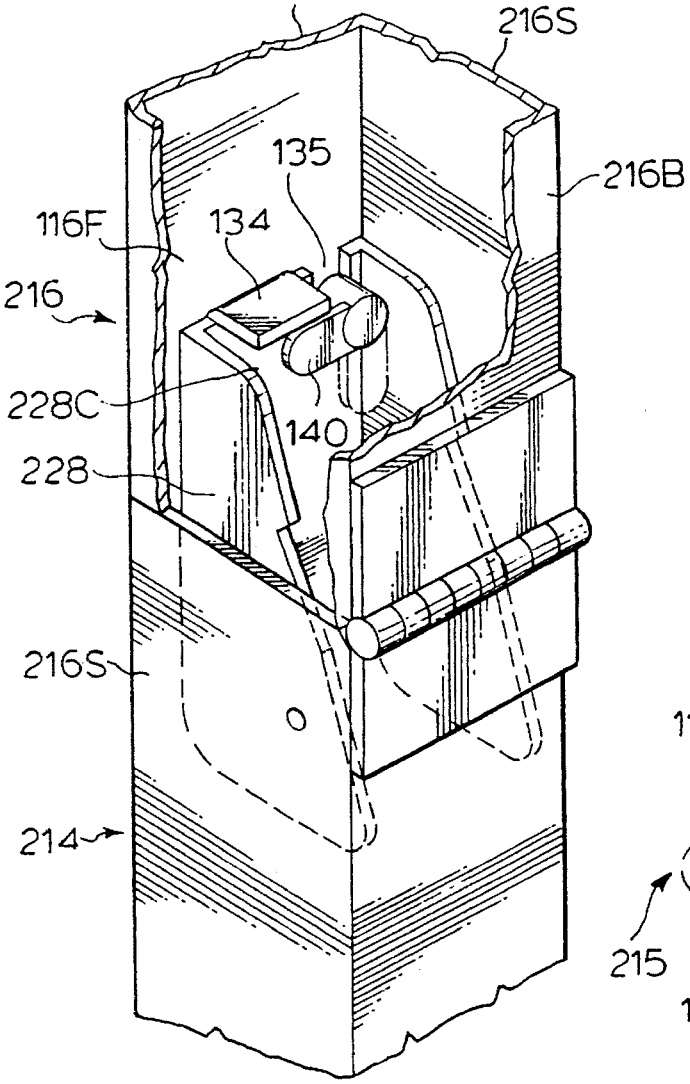
Figure 15:
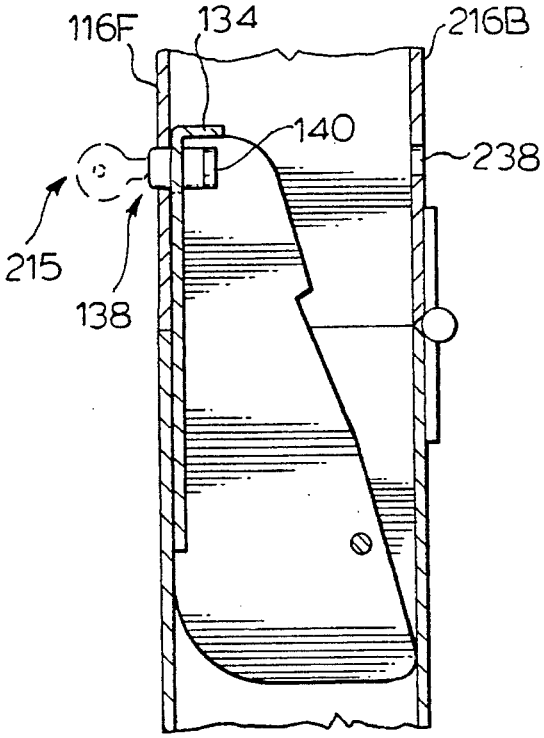
Figure 16:
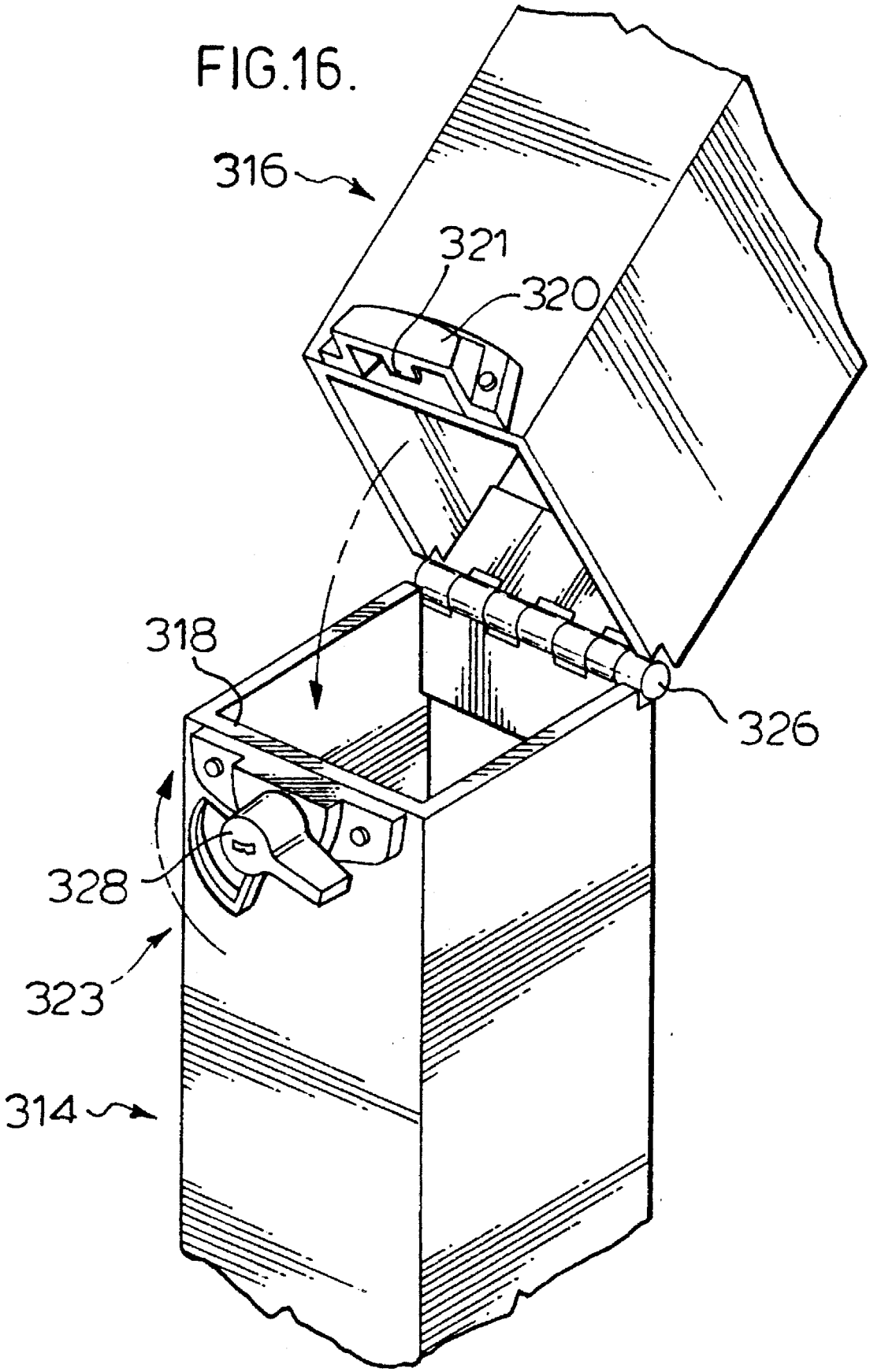

FIGS. 9 and 10 are partial, perspective views showing an alternate means for locking the cross-bar in PARALLEL or PERPENDICULAR relation, FIG. 11 is an exploded view and FIGS. 12 and 13 sectional views showing an alternate means for locking upper and lower upright extents in ERECTED position, FIG. 11A is a view of an arrangement alternate to, but similar to, that shown in FIG. 11, FIG. 14 is a perspective view and FIG. 15 a sectional view showing a further alternate means for locking upper and lower upright extents in ERECTED position, FIG. 16 shows a further alternate means for locking upper and lower upright extents in ERECTED position.

In the drawings,the general arrangement is that a mounting member 10 is insertable in the ground surface defining an upwardly projecting shank 12 preferably of rectilinear section.

The lower extent 14, upper extent 16 and cross-bar 18 are preferably of: (a) tubular construction (b) generally rectilinear section and (c) aluminium.

Parameters (a) (b) and (c) are variable within the scope of the invention.

The members need not be tubular although some preferred aspects of the invention will require this.

A tubular section need not be rectangular. The inventive features may be applied to tubular section which are square, cylindrical or other shape. However, best connection of the upper and lower extents requires a rectilinear (which herein includes 'square') construction. This gives a pleasant appearance and an attractive aspect ratio.

The material may, in place of aluminium, be steel, plastic (if of sufficient strength and thickness) or of wood. Although wood, would not normally be conducive to forming in a tubular shape, it would be suitable where the tubular arrangement was not required.

In accord with the preferred embodiment the lower extent 14 defines a generally rectangular tubular passage 20 and the section of shank 12 is designed to make a close sliding fit therewith.

The lower extent, upper extent and cross-bar are, in the preferred embodiment, of identical section and provided with longer sides and shorter sides using the designation of the member with S and L, respectively, added. The lower extent thus defines shorter sides 14S and longer sides 14L. Each extent defines a longitudinal direction. The upper end of the lower extent is cut at an angle of up to 65° to the longitudinal direction along a plane perpendicular to the shorter sides, so that for angles other than 0° one of the longer sides 14LA is shorter in the longitudinal direction than the other.

The upper extent is, at its lower end, cut in a similar manner, and at an angle to complement that of the lower extent, so that the two members may be placed end to end with their respective edges abutting. The members are pivotally joined by a hinge 26 defining a pivot axis parallel to the plane defined by the complementary edges and parallel to the longer side edges. The hinge 26 has its hinge plates (not shown) connected in any conventional manner to the respective abutting longer sides. It is within the scope of the invention to place the hinge connecting the short sides (so that the bevel and the sloping edges would slope from one short side to the other). However, a stronger hinge may be used and better connection achieved if the hinge connects the longer sides, as shown.

The hinge 26 is shown connecting the higher edge 14H of the lower extent to the higher edge 16H of the upper extent. However, it is within the scope of the invention to have the hinge connect the lower edge 14D of the lower extent to the lower edge 16D of the upper extent.

A core 28, which may be of wood, is designed to be snugly received in the tubular passage of one of the members have passage 20. The core extends from the passage 20 a short distance beyond the sloping edges and out of the passage to be level with the higher of the edges 14H. The core 28 may be firmly affixed to lower extent 14 by any conventional means, not shown. Thus the upper extent 16 may be swung into ERECTED position relation to the lower 14 with its passage 21 snugly fitting over the core. An aperture 31 in the longer wall 16LA of the upper member aligns with a bore 30 in the core. A bolt 34 may therefore be inserted through aperture and into the bore 30 to lock the members in ERECTED position.

I prefer to drill the wall 14LB opposite the bolt so that the bolt 34 may pass through opposed walls 16LA and 14LB and be fastened by a nut on the outside of wall 14LB (not shown).

However, it is within the scope of the invention to provide merely a bore 30 in the core and to provide a threaded plate at the entrance to the bore, to receive the bolt, as is done in furniture manufacture.

The bore and bolt are preferably transverse but may be sloped if desired.

The core may equally be fixed in the upper extent and the lower member bolted thereto.

The location of the hinge axis must be related to the degree of projection of the core, to ensure that there is no interference during pivotal operation of the extents while maintaining a snug fit with the other members when it is attached. As shown I prefer to locate the hinge at the meeting of the upper and lower extent edges and to terminate the projection of the core opposite the hinged edge.

It will be noted that with the single hinge of FIG. 3 the projecting edge 29 of the core, remote from the hinge has a height, relative to the hinge 26 which is limited by the necessity to avoid interference with edge 16D during relative pivotal movement of the members.

The point may be emphasized and an alternate embodiment shown in FIG. 3A which shows tubular lower and upper tubular extents 14A and 16A, respectively. These terminate in edges 14AD and 16AD which are each perpendicular to the longitudinal extents. The core 28A is affixed in any conventional manner to lower extent 14A and projects above edge 14AD and hinge 28A for snug reception in passage 21A. It is noted that for this to occur the core must be chamferred at 46 to allow passage of edge 16AD. Aperture 31A and bore 30A allow use of a bolt to fix the members in erected position.

The core 28 may be replaced by a reduced upper section of member 14, formed by swaging or conventional working of its wall extremities, with the reduced upper section being shaped to be slidably received in member 16, provided with a bolt aperture such as 30, and shaped to allow opening and closing movement of member 16. Equally the core 28 or reduced section may be part of section 16 and project into section 14 in closed position.

However the question of such interference is avoided and the core may be lengthened, thus strengthening the joint in ERECTED position by replacing the single hinge of FIG. 3 with the articulated links 78 shown in FIGS. 7 and 8A–8C. As shown side 14LB is provided with a pair of slots 74 extending parallel to the longitudinal direction of the member to its upper edge. In the ERECTED position of the member these slots align with slots 76 extending parallel to the longitudinal direction of side 16LB to its lower edge. Each part of aligned slots 74–76 is adapted to receive links 78 which are pivotally connected to these members along axes parallel to the wide dimension of the tubular member. As shown in FIGS. 7 and 8A–8C, the links allow the provision of a larger projection of core 80 from its attachment to the lower extent without causing interference with the upper extent as the latter swings into position. The provision of a larger projection together with a snug fit between core 80 and the upper extent 16 provides a more rigid joint in the erected position. As shown the core 80 preferably extends to an end face 82 which is parallel to the angle of the ends of the upper and lower extents. The projecting surface of the core which faces the direction of the link is provided with a projecting bolt shank 84 fixed thereto. The upper extent, just above its lower edge 16D is provided with an aperture 85 in wall 16LA, adapted to receive the bolt shank 84 to project outside the wall in the erected position for application of a nut 86 thereto. Thus, with the arrangement as demonstrated in FIGS. 7–8A–8C the members 14, 16 may lie side by side in the COLLAPSED position with core 80 projecting from member 14. When desired for use, extent 16 (FIG. 8A) is swung toward the ERECTED position, the links 78 allow the edge 16D to clear the core, the core to be snugly received in the passage 21 of extent 16 and the aperture to receive the shank 84 when the complementary edges of members 14 and 16 are abutting. A nut may then be tightened on shank 84 holding the members 14–16 firmly in erected position. (The shallow V cut out 81 in each link 78 allows a perfectly flat fold back of the linked members 14 and 16).

The upper extent near to its upper end is shaped to provide on one of its wide sides 16LB a rectilinear niche having parallel upper and lower edges along the narrow sides spaced as well as on side 16LB to receive a similar perpendicular tubular member therebetween and vertical edges 36 preferably half way between the wider sides. A similar arrangement is provided in a wide side 18LA of the cross-bar 18 so that the two members may be inter fitted in PERPENDICULAR attitude as shown in FIGS. 1, 4 and 5 with the wide sides of the crossed members having common planes due to the preferred interlock depth.

The niche may be more or less than one half the relevant thickness deep but the appearance and or the strength is thought to suffer.

It is within the scope of the invention to provide the niche in each of the cross-bar and upper extent narrower sides. However, the strength of the PERPENDICULAR connection between the cross-bar and the upper extent is believed much greater when the niches are cut in the wide sides of the members.

Returning to the preferred embodiment, the cross-bar wall 16 LB opposite the niche in one of the members is provided with a bolt aperture 40. Opposite the bolt aperture the upper extent is provided with a stirrup 42 comprising a bracket bearing ends 44 connected (by rivetting as shown, or otherwise) to spaced locations on the wall 16LA of the upper extent. Flanges 46 extend outward to support bridging strut 48 therebetween which is provided with an aperture 50 aligned with the aperture 40.

A bolt is provided with shank 51 extending through aperture 40 and has a head 52 attached and keyed to the outer end to allow manual rotation of the bolt. The bolt shank 51 is threaded but clears, loosely the edges of apertures 40 and 50. An enlargement 54 beneath head 52 bears on wall 18LB about aperture 40. A sleeve 56 is provided with internal and external threading, in the same sense. The inner threading is located only at an outer extent 58 of the sleeve inner passage, the rest of the inner passage being of wider diameter than the bolt. The inner threaded passage therefore receives the bolt with the bolt and passage threads meshed. The sleeve when threaded to the bolt extends inwardly loosely through aperture 50 in the bridging strut 48. A nut 60 is threaded into the inner end of the sleeve and is shaped to key against rotation on the flanges 46 of the stirrup. The inner end of the sleeve is peened outwardly at 62 so that its end cannot be screwed completely through nut 60.

The inner end of the inner passage of the sleeve also has peening 63 extending into the passage to prevent passage therethrough of the inner end 65 of shank 51. The length of shank 51 is chosen relative to that of sleeve 56, so that end 65 will contact peening 63 (on relative inner travel of the shank) before the outer end 67 of sleeve 51 contacts the inner side of wall 18LB (see FIG. 5).

Thus, the bolt shank 51 extends through cross-bar wall 18LB and threads into inside passage of sleeve 56 and the outside threading of sleeve 56 extends through the strut of stirup and is threaded into nut 60. Nut 60 and the stirrup act as the nut shank referred to in the introduction.

The cross-bar 18 is thus permanently attached to the upper extent 16 and the members may be pivotted relative to each other about the bolt axis between PERPENDICULAR (when not interlocked) and PARALLEL positions as hereinafter described.

The stirrup, sleeve 56, bolt shank and head are dimensioned so that with the sleeve's maximum outward excursion relative to the nut 60 and the bolt at its maximum outward excursion relative to the sleeve the members may be arranged side by side in PARALLEL relation, as shown in FIG. 6, occupying twice the thickness, measured along the bolt axis of one of the members 16 or 18. The members may be clamped in their PARALLEL relationship in by tightening the bolt head 52 for transportation or storage.

When it is desired to convert the relationship of members 16 and 18 from PARALLEL to PERPENDICULAR arrangement, the bolt, if clamped, is loosened and the members are relatively rotated to PERPENDICULAR orientation and moved into interlocking relationship as shown in FIG. 5 so that their thickness in the bolt axis direction is that of a single member 16 or 18, as shown in FIG. 5. The bolt is then tightened. It matters not which set of intermeshing threading turns easier. If it is the bolt shank 51 and the sleeve inside thread, then this turning occurs until the shank end 65 contacts the inner sleeve peening 63. The sleeve will then turn in nut 60 until the members are clamped in PERPENDICULAR orientation. The inward bolt movement will equally operate if, initially the shank 51 turns with sleeve 56 and the sleeve rotates in the nut until the sleeve contacts the wall 18LA and the nut contacts the inside of plate 48 and then the bolt turns in the sleeve until clamping in PERPENDICULAR orientation takes place.

To return the PERPENDICULAR members 16 and 18 to PARALLEL position the bolt is rotated in the opening direction. If the bolt initially turns relative to the sleeve then this takes place until the bolt peening contacts shoulder 69 inside the sleeve, after which the sleeve rotates until the sleeve peening 62 contacts the nut 60 and the latter may contact the inner side of the plate 48. The effective bolt and sleeve length is then sufficient to allow separation of the interlocked members to allow their orientation to PARALLEL position and clamping. The device works equally if the sleeve rotates first relative to the nut until the peening 62 stops relative rotation and then the bolt rotates relative to the sleeve.

Cross-bar 18 is provided with hooks 70 to allow suspension of a suitable sign therefrom.

In overall operation with the upper and lower extents 14 and 16 in COLLAPSED position and the upper extent 18 in PARALLEL position (FIG. 2) the post support is erected as follows.

The ground support stake 10 is entered into the ground. The lower extent may then be mounted thereon by sliding over the projection 12 of the ground support stake. The upper extent may then be rotated into ERECTED position and fixed in place by placing bolt 32 into the core and tightening to the nut provided. The cross-bar may then be moved into PERPENDICULAR position and clamped as previously described.

It will be appreciated that the three operations:

(a) mounting the lower extent on the stake, (b) moving the lower and upper extents to ERECTED position, (c) rotating and clamping the cross-bar and upper extent in PERPENDICULAR position, may be done in any sequence. Afterward the requisite sign 72 is hung from the cross-bar.

Similarly, the conversion of a sign in use FIG. 1 to the storage version involves first removing the sign 72 from the hooks 70. The three operations:

(d) removing the lower extent from the stake, (e) moving the upper and lower extents to COLLAPSED position, (f) may the upper extent and the cross-bar to PARALLEL position, may be performed in any desired order.

With regard to the embodiment of FIGS. 5 and 6 it is noted that Stirrup 42 side walls (not shown) may provided extending between walls 46 to key to the nut 60 so that the nut is keyed on four sides.

With regard to the embodiment of FIGS. 5 and 6 it is noted that, if desired, the nut 60 may be affixed to, and/or an integral part of the stirrup and as such would be located in the position shown in FIGS. 5 and 6.

FIGS. 5A and 6A show an alternate arrangement to that shown in FIGS. 5 and 6. In FIGS. 5A and 6A, opposite the bolt aperture 40 the upper extent is provided with a stirrup 92 comprising bracket bearing ends 94 connected (by riveting, or otherwise) to spaced locations on the wall 16LA of the upper extent. Flanges 96 extend outward to support bridging strut 98 extending therebetween which is provided with an aperture 100 aligned with the aperture 40. Flanges 96 are provided with slots 97A, 97B which extends from near the outer to near the inner end. The slots are provided with a right angled turn into an end extent 102A and 102B adjacent their inner end. The direction of the turn is in the sense of a clockwise rotation looking inward along the axis defined by apertures 40 and 100. A leaf spring 99 is associated with each slot, and may be a separate member or part of the flange 96 material and the leaf spring is adapted to bias a stub 108 in slot 97A or 97B into the end extents 102A and 102B. (It is noted that spring 99 assists in the smooth and efficient operation but is not essential.)

A bolt is provided with shank 51 extending through aperture 40 and has a head 51' attached and keyed to the outer end to allow manual rotation of the bolt. The bolt shank 51 is threaded but clears loosely the edge of aperture 40. A sleeve 106 is provided with internal threading to mesh with bolt shank 51 threading and the sense of the threading is such that clockwise (inward) rotation of boltshank 51 carries it into sleeve 106. The sleeve 106 is provided on its outer surface with stubs 108 adapted to ride in slots 97A and 97B. In operation the allowed travel of the shank 51 into the sleeve plus the length of travel of stubs 108 in slots 97A, 97B represents the change in transverse dimension between the PARALLEL and PERPENDICULAR position.

Accordingly, with the upper extent 18 and cross-bar 18 in the PARALLEL position the bolt head is loosedned sufficiently that the members 16, 18 may be rotated to PERPENDICULAR position. The bolt head is then pressed inward causing sleeve 106 to carry stubs 108 to the inner end of slots 97A, 97B where leaf springs 99 cause the stubs 108 to move into the right angled extents 102A and B. The bolt head 51' is then tightened relative to sleeve 106 to move cross-bar 18 into fully interlocked position relative to the upper extent 16. The use of the bayonet mounting, stubs 108 and slots 97 represents a considerable time saving in sign assembley over the embodiment of FIGS. 5 and 6.

When it is desired to move the cross-bar and upper extent from PERPENDICULAR to PARALLEL position the bolt head 51 is first rotated counter-clockwise until peened end 65 strikes the sleeve shoulder 69. The sleeve then rotates counter clockwise with the bolt head, carrying stubs 108 out of end extents 102A, 102B against the bias of leaf spring 99 so that the stubs 108 may be moved to the outer ends of slots 97A & 97B. The cross-bar and upper extent members may now be moved completely out of interlocked position so that they may be relatively rotated to PARALLEL position and clamped in this position by a slight tightening of bolt head 51. Once again the use of the bayonet of FIGS. 5A and 6A saves time.

If desired the control 52 or 51' for bolt shank 51 may be welded thereto, or otherwise fastened.

There will now be described further alternative means which do not require central cores of FIGS. 3, 3A, 7 or 8A–8C.

In FIGS. 11, 12, 13 there is shown a variant wherein a sign upright has a lower extent 114 and an upper extent 116 connected by a simple pivot means embodied by the hinge 126. Each extent 114 and 116 is of rectangular tubular form with respectively corresponding walls of the extents 114 and 116 co-planar with each other in the ERECTED position shown in FIG. 13. Thus, walls 114LB and 116LB are co-planar, and the hinge 126 connects these walls and defines a pivot axes parallel thereto.

A coupling member 128 is pivotally mounted by pin 129 in aligned apertures 133 (one, only, is shown) on opposed walls 114S of extent 114 to pivot about an axis 130 parallel to the axis of hinge 126 but displaced therefrom. The member 128 pivots between the coupling position shown in FIG. 13 where the extents 116 and 114 are in ERECTED position and the position shown in FIG. 12 which allows the extents to be rotated relative to each other toward collapsed position.

The member 128 defines a rectangular U shaped section when viewed along the mutual longitudinal axes of the extents. A wall 128C being the cross-bar of the U is designed to be parallel to and rest against the walls 116F and 114F in the ERECTED position, while the walls 128U forming the uprights of the U are in all positions parallel to and slide on respective extent side walls 114S of the lower extent 114 and side walls 116S of the upper extent. Thus the three pairs of side by side walls at both lower and the upper extent contribute to the rigidity of the support in ERECTED position.

For detachably attaching the coupling member to the extent 116 in ERECTED position the wall 128C is provided with a threaded bolt 134 which projects through slot 130 in wall 114F in ERECTED position. Slot 130 must be sufficiently elongated to allow rotation of the coupling member into and out of ERECTED position. A nut 136 may be attached to the threaded bolt to secure it firmly in ERECTED position. The triangle formed by the nut 136, pivot axis 130 and that of hinge 126 rigidly and securely holds the extents in ERECTED position.

A pusher hole 138 is provided in wall 114B located to be opposite bolt 134 in ERECTED position so that a rod (not shown) may be used, if necessary, to push coupling member 128 to move bolt 134 through slot 130 when moving into ERECTED position. In addition walls 128U may be each provided with a cam extension 140 which projects toward wall 116LB aiding rotation of wall 116LB toward erected position. The weight of member 128 is also distributed, relative to pivot axis 130 so that with extent 114 upright, the member 126 is gravity; biased toward its ERECTED orientation through the last part of the arc of movement toward erected position.

In operation, with the support in ERECTED position as shown in FIG. 13, when it is desired to move to COLLAPSED position (which will be similar to that of members 14 and 16 in FIG. 2), nut 136 is removed. Bolt 134 is then pushed through slot 130 with the finger while the members 114, 116 are rotated toward COLLAPSED position. During such rotation the member 116 will carry bolt 134 and coupling member 128 to the position of FIG. 12 so the member 116 may move to COLLAPSED position. To move to erected position the rotation of member 116 toward ERECTED position with member 114 upright, first moves coupler 128 by contacting cam extensions 140. The gravity bias should then rotate coupler 128 so that bolt 134 projects through slot 130. If this does not occur then a rod may be thrust through pusher hole 138 to move bolt 134 through slot 130. The nut may then be applied to fasten the members in ERECTED position.

FIG. 11A shows a plate member 428 designed to perform the same function as the member 128 of FIG. 11. Plate member 428 has curled portion 430 for pivotally mounting the plate on pin 129. Member 428 has an upper panel 428A located to rest against wall 116F in the ERECTED position of member 114 and 116. Contiguous extending from upper panel 428A is lower panel 428B which in turn, contiguously extends into curled portion 429. Lower panel 428B, in the erected position of members 114 and 116, extends (in ERECTED attitude) diagonally upwardly from pin 129 to wall 116F below slot 130. Panel 428A mounts a bolt 134 with the same arrangement and function as bolt 134 in the embodiment of FIG. 11A. Opposed edges 431 of panel 428A and opposed edges 432 of panel 428B are adapted to move slidably along side walls 114S and 116S as the members 114 and 116 move between ERECTED and COLLAPSED position. Thus in operation, in the ERECTED position (see dotted outline) bolt 134 extends through slot 130 and is bolted to wall 116F by a nut. The members 114, 116 are maintained rigidly in erected position by: nut 136, pin 129 and hinge 126. The contact between the opposed edges 431 and opposed edges 342 and respectively opposed walls 114S and 116S adds (in both ERECTED position and in movements thereto and therefrom) rigidity to the assembly and reduces torsion stresses on the hinge 26 and pivot pin 129.

The operation of member 428 in movement of the members between ERECTED and COLLAPSED position is, in other aspects, the same as the operation of member 128 in the embodiment of FIGS. 11–13.

FIGS. 14 and 15 show an alternative arrangement where the upper and lower extents are hinged as in the previous embodiment. The body coupling member 228 and its pivot mounting is the same as coupler 128 of the previous embodiment. However instead of bolt 130 there is provided a horizontal flange 134 projecting inwardly from pivot 130. A key operated lock 138 is provided in wall 116F to be beside and just lower than flange 134. In ERECTED position the barrel of lock 138 rides in an upwardly opening slot 135 in wall 228C. A tab 140 is combined with the lock and adapted to project downwardly (dotted line position) when unlocked, and when locked (solid line position) to contact the flange 134. The tab 140 is spaced from wall 228C to allow wall 116F to rotate therepast when the lock is unlocked.

In operation with the members 214 and 216 in ERECTED position, and the lock locked, tab 140 will contact flange 134 preventing movement of extent 216 toward COLLAPSED position. To move the members to unlocked position the key 215 is used to unlock the lock and moves tab 140 to its vertical, dotted line position. The member 216 may then be rotated to COLLAPSED position and coupling member 228 will move clockwise in FIG. 15 sufficiently to allow such movement.

To move from COLLAPSED position to ERECTED position, member 216 is rotated with member 214 vertical, into ERECTED position. The coupling member 228 will move into coupling position initially under the impetus of the wall 216B and then under gravity or by a 'push' through pusher 238. Once the coupling member 228 is in place with its three walls against the three walls 216S, 216F and 216S it may be locked in place by key 215 in lock 138.

FIG. 16 shows a further method for detachably fastening the upper and lower extents in ERECTED position. These figures show a hinged connection 326 as in the previous embodiments defining an axis perpendicular to the longitudinal axes of upper and lower extent members 316 and 314 in the ERECTED position. The matching edges 320 and 318 of members 316 and 314 are perpendicular to the longitudinal axes of the member. As shown in FIG. 16 the member 316 mounts a window sash fitting 320 while the member. 314 mounts a cooperating swivel 323 with its conventional spiral ramp. Thus the members, in ERECTED position have the swivel 323 engaging the tooth 321 in fitting 320, and, in combination with hinge 326 securely hold the members in ERECTED position. Preferably, as shown the swivel is provided with a key-operated lock 328 which, when set, holds the swivel in position. When it is desired to move the support to COLLAPSED position the key is used to unlock the lock 328 and the swivel 323 rotated to disengaged position. The upper extent 316 is then rotated to COLLAPSED position beside the lower extent 314. To move the members to the erected position the process is reversed.

If desired the window sash fastening may be replaced by a conventional fastener of the lunch-box type which is also susceptible to the addition of a key or combination lock.

The alternatives with window sash or lunch box locking means each provide a convenient fastening in the ERECTED position which is convenient and rigid and does not require the linkages, cores or coupling members of the other embodiments.

FIGS. 9 and 10 show means for connecting a sign cross-bar 18 with a support extent 16 which are an alternative to the connections, for the same purpose, shown in FIGS. 4–6 (a first variant) or in FIGS. 5A and 6A (a second variant). Both the first and second variants provide means for securely fastening the cross-bar 18 and support 18 in either PERPENDICULAR or COLLAPSED position. However both are slower than desirable by some user's because their operation involves screw action.

In the embodiment of FIGS. 9 and 10 a faster operating connection is described. In FIGS. 9 and 10 a sleeve 440 is permanently fixed on wall 16LA of the upper extent 16 to project toward wall 16LB (see FIG. 6). Sleeve 440 carries an axial slot 442 which has a right angled slot 444 at its inner end, here running clockwise looking inward from the inner end of slot 442.

A sleeve 446 is dimensioned to slide and rotate in sleeve 440. Sleeve 446 is provided with a stud 448 adapted to project from the surface of sleeve 446 and to ride in slots 442 and 444. Stud 448 is mounted retractable and spring loaded to projecting position and may be retracted to allow insertion, with its sleeve, in sleeve 440.

Sleeve 446 is provided with an axial slot 449 having a right angled turn 450 in an inward—clockwise sense at its inner end.

A third sleeve 452, is provided with a spring biased retractable stud 454, is inwardly threaded to receive threaded bolt 453 which may be screwed inward in sleeve 452 by clockwise rotation under the control of handle 456 which may be fixed on bolt 453 by any conventional means, such as the lock nuts 458 shown. The inward threading on sleeve 452 is provided with inner and outer rotation stops (not shown) for bolt 450. Bolt 456 projects through an aperture in wall 18LB as does bolt 51 in FIG. 6.

The combined axial movement of the studs in slots 442 and 448 approximates the change in transverse thickness of members 16 and 18 between PARALLEL and PERPENDICULAR position (compare FIGS. 5 and 6).

In operation, with the members in PARALLEL position, by analogy to FIG. 6, and bolt 456 sufficiently screwed to clamp them in this position, the movement to PERPENDICULAR position is performed as follows:

Bolt 456 is loosened so that the cross-bar 18 may be rotated 90° relative to extent 16 and the members are then moved into interlocking position (see, by analogy FIG. 5).

Bolt 456 is then moved axially inward until studs 448 and 454 move to the inward ends of the slots. The bolt 453 is then rotated clockwise and it is expected that the frictional drag of the bolt threading will move each stud into its respective right angled slot. If the frictional drag does not place the studs in the right angled slots, then the bolt will reach its inner rotation stop and positively perform the required clockwise rotation to place the studs in the slots. The cross-bar 18 is then securely locked in PERPENDICULAR relation to the extent 18.

For movement back to parallel relation the procedure is reversed. if the frictional drag of bolt threading does not move the studs out of the slots, the bolt will rotate to its outer rotation stop to positively move the studs. When the studs are again in the axial slots, they may be moved to the outer ends and the members separated from interlocked position, to be rotated to PARALLEL position where they may be clamped by tightening bolt 456.

The studs and slots may be reversed between interacting members but will require an opposite sense of bolt rotation for the same bolt direction. The right angle slots may both be directed in the opposite sense, but will require opposite bolt rotation.

The embodiment of FIGS. 9 and 10 will provide much faster erection and dismantling of the cross-bar than with the other alternatives or with previously known sign designs.

The hinges 26, 126, 226, 326 shown herein are mounted outside the extents to which they are attached. They may, alternatively, be mounted inside but, it is thought at more trouble and expense.

I claim:

1. Support post comprising:

a lower extent defining a longitudinal extension direction, an upper extent defining a longitudinal extension direction, the upper end of said lower extent being swingably connected to the lower end of said upper extent, said extents being adapted to move as controlled by said swingable connection between an ERECTED position where said extents are aligned and a COLLAPSED position where said extents are side by side, said upper and lower extents being tubular members, a coupling member swingably connected to one of said upper and lower extents, having a connection end resting in said one of said extents and a coupling end being adapted, in ERECTED position to be received in the other of said extents and connected and shaped adjacent said coupling end to provide a member adapted to be detachably coupled to a wall of said other extent in ERECTED position, and when detached to swing to allow relative rotation between said extents out of ERECTED position toward collapsed position.

2. Support post as claimed in claim 1 wherein said extents are each of generally rectangular section with four walls defining each section and each wall of one section being, in ERECTED position, approximately co-planar with one of the walls of the other section, wherein said extents are connected to swing relative to each other, about first axes parallel and adjacent to one of the walls so co-planar, wherein said coupling member is swingably connected to said one of said extents to swing relative thereto about second axes parallel to said first axes but having a different locus.

3. Support post as claimed in claim 2 wherein said coupling member is U shaped in section perpendicular to the said one member longitudinal extent, said U shaped member in section therefore, defining a wall forming the cross-bar of said U and two wall forming the uprights of said U, said 'cross-bar' wall being adapted in the ERECTED position to be immediately adjacent to the first wall of said other extent and said 'upright' wall each being adapted in the erected position to be adjacent to walls of said other extent which are perpendicular to said first wall.

4. Support post as claimed in claim 1 wherein said coupling member is mounted to move between a first limiting position for coupling to said other extent and a second limiting position allowing said rotation toward collapsed position.

5. Support post as claimed in claim 2 wherein said coupling member is mounted to move between a first limiting position for coupling to said other extent and a second limiting position allowing said rotation toward collapsed position.

6. Support post as claimed in claim 1 wherein fastening means are provided for releasably maintaining coupled said coupling member.

7. Support post as claimed in claim 2 wherein fastening means are provided for releasably maintaining coupled said coupling member.

8. Support post as claimed in claim 1 wherein said upper and lower extents are pivotally connected and said coupling member is pivotally connected to one of said extents.

9. Support post as claimed in claim 3 wherein said upper and lower extents are pivotally connected and said coupling member is pivotally connected to one of said extents.

10. Support post comprising:

a lower extent defining a longitudinal extension direction, an upper extent defining a longitudinal extension direction, the upper end of said lower extent being swingably connected to the lower end of said upper extent, said extents being adapted to move as controlled by said swingably connection between an ERECTED position where said extents are aligned and a COLLAPSED position where said extents are side by side, a fastening member adapted to releasably fasten said extents in ERECTED position.

11. A support post as claimed in claim 10 wherein said swingable connection is a pivotal connection.

12. A support post as claimed in claim 10 wherein said fastening member is of the window fastener type.

13. A support post as claimed in claim 12 wherein said fastening member is of the window fastener type.

14. A support post as claimed in claim 10 wherein said fastening member is of the lunch-box type.

15. A support post as claimed in claim 11 wherein said fastening member is of the lunch-box type.

16. A support post as claimed in claim 14 wherein said fastener is combined with a key operated locking means.

17. A support post as claimed in claim 15 wherein said fastener is combined with a key operated locking means.

18. Support post comprising:

a longitudinal extent adapted to act as part of the upright for a sign, a cross-bar defining a longitudinal direction, means connecting said cross-bar with said extent, allowing pivotting there between, said connecting means allowing rotation of said cross-bar between an orientation PERPENDICULAR to said extent, and an orientation PARALLEL thereto, and wherein said extent and cross-bar are shaped to interlock and to key against relative rotation when in said PERPENDICULAR orientation, wherein said extent and cross-bar together have a lesser thickness along a width axis perpendicular to both in the PERPENDICULAR orientation than they have together in the PARALLEL orientation.

19. Support post as defined in claim 18 wherein a rotatable shank extends from one of said tubular members toward the other, control means are mounted on said shank exterior to said on of said members, a sleeve adapted to rotate relative to said shank and to telescope axially with respect thereto, a non-rotating member mounted on said other of said members, adapted to rotate relative to said sleeve and to telescope axially with respect thereto, an axial slot in one of said sleeve and said rotating member and a stud in the other, adapted to ride in said slot, a transverse turn at one end of said slot corresponding to the maximum axial overlay of said members, said stud moving into said transverse turn on rotation of said rotating member relative to said sleeve in a predetermined sense, an axial slot in one of said sleeve and said non-rotating member and a stud in the other, adapted to ride in said slot, a transverse turn at one end of said slot corresponding to the maximum axial overlap of said members, said stud moving into said transverse turn on rotation of said sleeve relative to said non-rotating member in said predetermined sense, whereby the combined available axial extension between said sleeve and said rotating member, on the one hand, and between said sleeve and said non-rotating member on the other hand allows the movement along said axis required between said extent and cross-bar to move between PARALLEL and PERPENDICULAR orientations.

20. Support post as claimed in claim 18 including means for locking said members in PERPENDICULAR orientation.

21. Support post as claimed in claim 19 including means mounted on said rotatable member for locking said members in PERPENDICULAR orientation.

22. Support post as claimed in claim 18 wherein said connecting means is adjustable and selectively adapted to assume, in said PERPENDICULAR orientation, a shorter length adapted to clamp said extent and cross-bar members in interlocked relationship, and selectively adapted to assume a longer length adapted to allow withdrawal of said members from interlocked relationship.

* * * * *